US006019447A

United States Patent [19]

Jackovin

[11] Patent Number: 6,019,447

[45] Date of Patent: Feb. 1, 2000

[54] REFRIGERATOR WITH VARYING WIDTH FRESH FOOD AND FREEZER COMPARTMENTS

[75] Inventor: Gary B. Jackovin, Ankeny, Iowa

[73] Assignee: Maytag Corporation, Newton, Iowa

[21] Appl. No.: 09/139,124

[22] Filed: Aug. 25, 1998

[51] Int. Cl.[7] ..... A47B 96/04

[52] U.S. Cl. ..... 312/405; 312/401; D15/81

[58] Field of Search ..... 312/401, 402, 312/404, 405, 406, 407, 407.1, 116; D15/79, 80, 81, 85; 49/501; 52/784.1, 610; 62/339, 340, 337, 382

[56] References Cited

U.S. PATENT DOCUMENTS

| | | | |
|---|---|---|---|
| D. 143,753 | 2/1946 | Pinelli | D15/81 |
| D. 264,752 | 6/1982 | Leotta | D15/79 |
| D. 379,095 | 5/1997 | Sparks | D15/85 |
| 1,908,532 | 5/1933 | O'Connor . | |
| 2,914,218 | 11/1959 | Korodi | 222/131 |
| 3,075,366 | 1/1963 | Jung | 62/382 |
| 3,851,939 | 12/1974 | Benasutti et al. | 312/116 X |
| 5,211,462 | 5/1993 | Bien et al. | 312/407.1 X |
| 5,568,712 | 10/1996 | Jenkins et al. | 312/405 |
| 5,588,731 | 12/1996 | Schmidt et al. | 312/405 |
| 5,707,518 | 1/1998 | Coates et al. | 62/339 |
| 5,735,586 | 4/1998 | Cheng | 312/235.1 |

*Primary Examiner*—Peter M. Cuomo
*Assistant Examiner*—James O. Hansen
*Attorney, Agent, or Firm*—Everett G. Diederiks, Jr.

[57] ABSTRACT

A side-by-side refrigerator includes fresh food and freezer compartments each having upper and lower sections which vary in width and volume. In accordance with a preferred embodiment, the fresh food compartment is wider at an upper portion than at a lower portion thereof and the freezer compartment is wider at a lower portion than at an upper portion, while the overall cabinet width of the refrigerator does not deviate from that of a conventional side-by-side refrigerator arrangement. Due to the interior size alterations, the fresh food and freezer doors of the side-by-side refrigerator are correspondingly configured and a mullion dividing the two refrigerator compartments extends in laterally offset vertical planes. An ice and/or water dispenser can be provided, such as in the freezer door or fixed relative to the fresh food and freezer doors in a central zone which is arranged vertically and laterally between portions of the doors.

22 Claims, 3 Drawing Sheets

REFRIGERATOR WITH VARYING WIDTH FRESH FOOD AND FREEZER COMPARTMENTS

BACKGROUND OF THE INVENTION

1. Field of the Invention

The present invention pertains to the art of refrigerators and, more particularly, to a side-by-side refrigerator including laterally spaced fresh food and freezer compartments each having upper and lower storage sections of differing widths.

2. Discussion of the Prior Art

In a conventional side-by-side refrigerator, freezer and fresh food compartment doors align along a vertically extending divider wall or mullion, with the mullion extending in a single plane essentially from the top to the bottom of the refrigerator. Although this style of refrigerator has certain advantages over top-mount refrigerators wherein the freezer compartment is arranged vertically above the fresh food compartment, certain disadvantages are also presented. For instance, since the opening provided in a household kitchen for both side-by-side and top-mount refrigerators is essentially standard, top-mount style refrigerators typically have wider shelves in each of the fresh food and freezer compartments as compared to the corresponding shelves in a side-by-side refrigerator.

For this reason, it is often difficult, if not impossible, to accommodate rather wide food items, such as trays, cake pans, platters, turkeys and the like, on a given shelf in the fresh food compartment of a side-by-side refrigerator, while the same item(s) could be readily placed on a corresponding shelf in a top-mount refrigerator. The same is true with respect to the width of the different freezer shelves. For example, it is often difficult to store frozen pizzas and other large food items widthwise in a side-by-side refrigerator freezer compartment, while such items can be easily arranged in the freezer compartment of a top-mount refrigerator. To compensate for this disadvantage, it is not uncommon for owners of side-by-side refrigerators to purchase a second refrigerator for additional food storage space.

Based on at least these reasons, there exists a need in the art for a side-by-side refrigerator which can still fit in a standard sized refrigerator opening, yet will accommodate wider food items than a conventional side-by-side refrigerator. More specifically, there exists a need for an improved side-by-side refrigerator having widened refrigerator and freezer storage compartment sections, as compared to a conventional side-by-side refrigerator, in order to enable somewhat wider food items to be readily accommodated within these compartments.

SUMMARY OF THE INVENTION

A side-by-side refrigerator includes laterally space fresh food and freezer compartments, each of which includes upper and lower compartment sections having varying widths. More specifically, in accordance with a preferred embodiment of the invention, the fresh food compartment is wider in an upper section than in a lower section, while the freezer compartment is wider in a lower section and more narrow in an upper section. With this construction, shelves supported in the upper section of the fresh food compartment are laterally elongated as compared to corresponding shelves in a conventional side-by-side refrigerator. Broadly, the upper section of the fresh food compartment could simply be widened to create varying width upper and lower sections in both the fresh food and freezer compartments. However, in the most preferred form of the invention, the lower section of the freezer compartment is also wider than a corresponding section in a conventional side-by-side refrigerator. In any event, with this construction, the upper section of the fresh food compartment and the lower section of the freezer compartment can accommodate larger food items than previously possible.

The varying width refrigerator compartment sections of the invention are preferably defined by liners arranged within a shell of the refrigerator and can be selectively accessed by pivoting respective fresh food and freezer doors which are adapted to seal against the shell and a compartment dividing mullion. The mullion itself has upper and lower portions extending in laterally offset, fore-to-aft extending vertical planes. The refrigerator of the invention can also incorporate an ice and/water dispenser. In one embodiment, the dispenser is arranged in the freezer door in a manner corresponding to a conventional side-by-side refrigerator design. In another embodiment, the dispenser is fixed, preferably in a mullion zone between the fresh food and freezer compartments, with the fresh food and freezer doors simply extending about the dispenser. With this arrangement, the dispenser can function whether the doors are open or closed and any movable, potentially problematic junction between the dispenser and an ice maker is eliminated.

Additional objects, features and advantages of the present invention will be more readily apparent from the following detailed description of preferred embodiments of the invention, when taken in conjunction with the drawings wherein like reference numerals refer to corresponding parts in the several views.

DETAILED DESCRIPTION OF THE PREFERRED EMBODIMENTS

Figure 1:
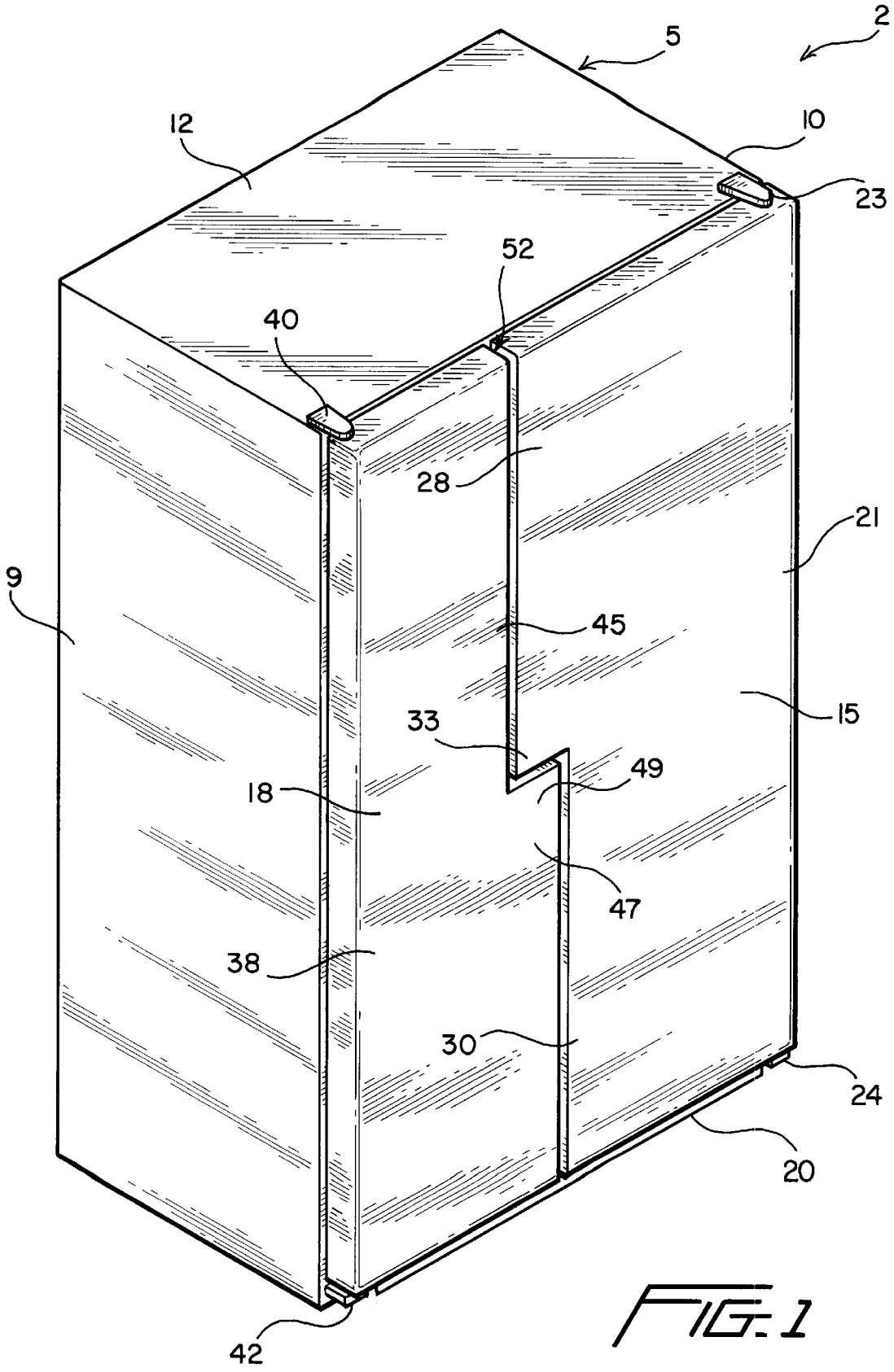
FIG. 1 is upper front perspective view of a refrigerator cabinet constructed in accordance with a first preferred embodiment of the invention.

With initial reference to FIG. 1, a refrigerator cabinet constructed in accordance with a first preferred embodiment of the present invention is generally indicated at 2. In general, refrigerator cabinet 2 includes a cabinet shell 5 formed from side panels 9 and 10 which are interconnected by a top panel 12. Preferably, cabinet shell 5 is formed from bending a single piece of sheet metal in a manner known in the art. As illustrated, refrigerator cabinet 2 constitutes a side-by-side refrigerator having a fresh food compartment door 15 which is arranged laterally juxtaposed a freezer door 18. Extending laterally across cabinet shell 5, below fresh food and freezer doors 15 and 18 is a kickplate 20. Aside from the aspects which will be described more fully below, the basic construction and operation of refrigerator cabinet 2 is known in the art, does not form part of the present invention and therefore will not be discussed further herein.

Fresh food door 15 includes an outer vertical edge portion 21 which is pivotally attached to cabinet shell 5 through upper hinge 23 and a lower hinge 24. In accordance with the present invention, fresh food door 15 includes an upper inner edge portion 28, a lower inner edge portion 30 and a lateral edge portion 33 interconnecting the upper and lower inner edge portions 28 and 30. Therefore, upper and lower inner edge portions 28 and 30 are laterally spaced and extend in vertically offset planes or axes. In a generally similar manner, freezer door 18 includes an outer edge portion 38 which is pivoted at upper hinge 40 and lower hinge 42 for movement relative to cabinet shell 5. In addition, freezer door 18 includes an upper inner edge portion 45, a lower inner edge portion 47 and a lateral edge portion 49. While lateral edge portions 33 and 49 are shown to extend generally horizontal, it should be understood that these portions could be curvilinear, diagonal or the like without departing from the invention.

With this construction, as opposed to a conventional side-by-side refrigerator wherein inner edge portions of fresh food and freezer doors would be spaced by a vertical, single axis gap, fresh food and freezer doors 15 and 18 in accordance with the present invention are spaced in a central zone of refrigerator cabinet 2 by a gap 52 that includes a first vertical component between upper inner edge portions 28 and 45, a lateral component between lateral edge portions 33 and 49 and a second vertical component between lower inner edge portions 30 and 47. Therefore, fresh food door 15 is wider in an upper portion thereof than in a lower portion. Correspondingly, freezer door 18 is wider in a lower portion than in an upper portion. As will become more fully evident below, fresh food and freezer doors 15 and 18 conceal fresh food and freezer compartments of refrigerator cabinet 2 which also have varying width upper and lower sections in accordance with the present invention.

Figure 2:
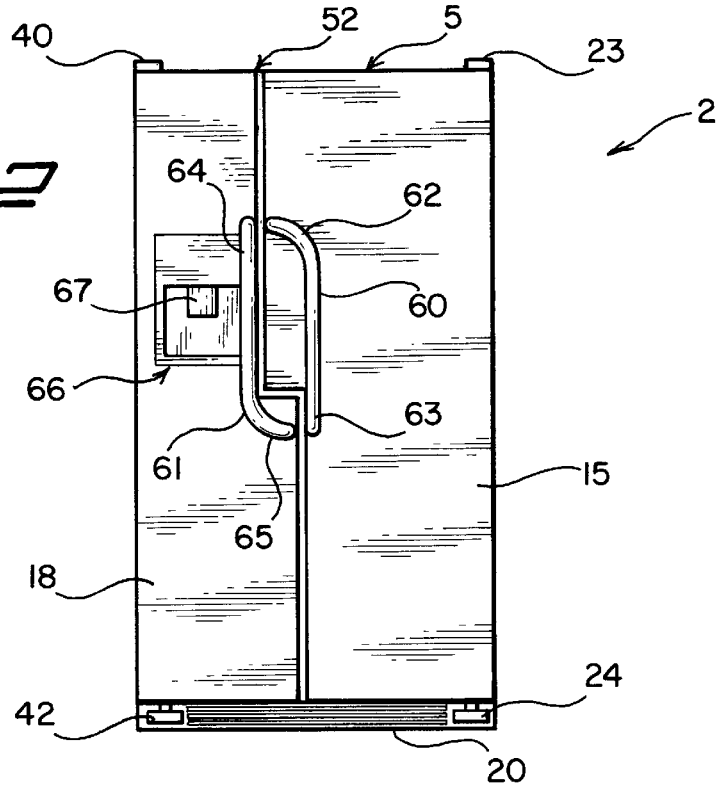
FIG. 2 is a front plan view of a refrigerator cabinet constructed in accordance with a second preferred embodiment of the invention illustrated in a closed condition.
Figure 3:
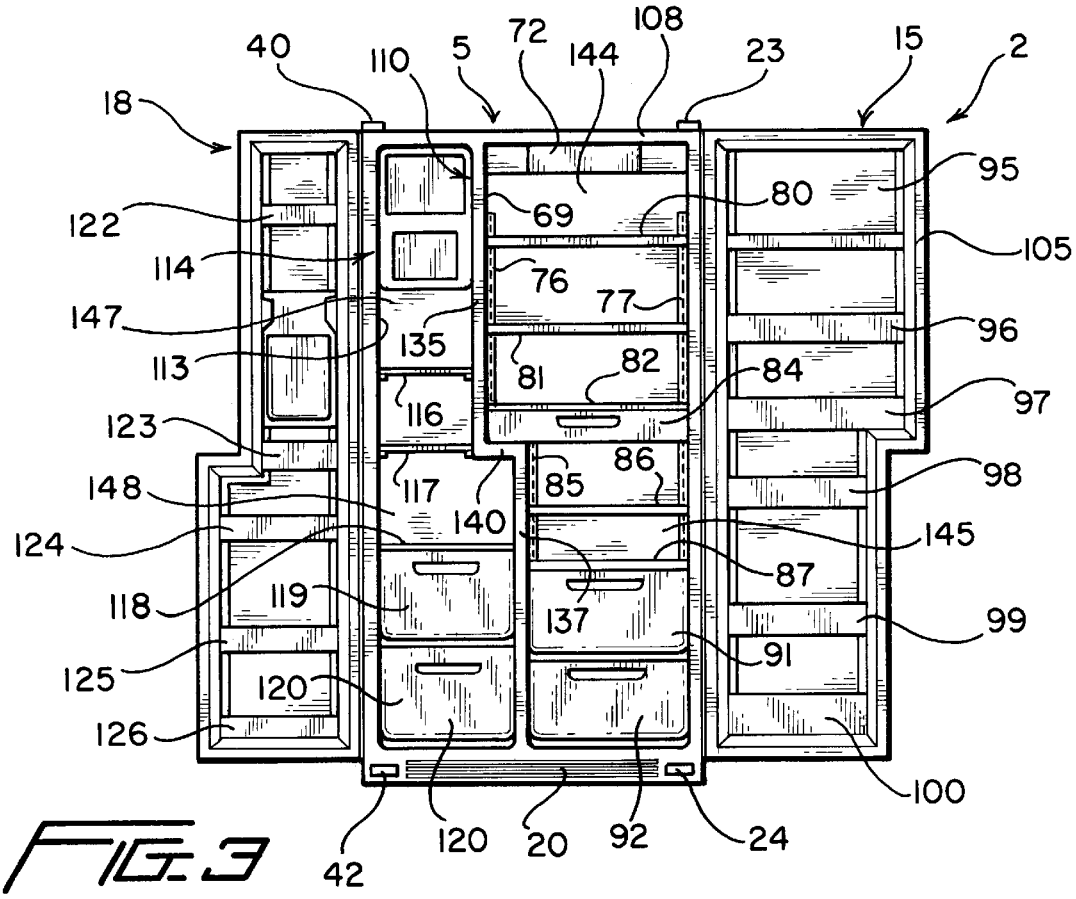
FIG. 3 is a front plan view of the refrigerator cabinet of FIG. 2 in an open condition.

FIGS. 2 and 3 represent a slightly modified embodiment of the invention and provides further details about the interior construction of refrigerator cabinet 2. To arrive at this embodiment, the embodiment of FIG. 1 has been modified to incorporate handles 60 and 61 for fresh food and freezer doors 15 and 18 respectively. In the embodiment of FIG. 1, handles have not been depicted for the sake of simplicity, yet it is to be understood that handles corresponding to those indicated at 60 and 61, or various other types of handle arrangements, would be provided. In this second embodiment, handle 60 includes a curved upper section 62 and a generally vertical section 63, while handle 61 is provided with a generally vertical section 64 leading to a curved lower section 65. Again the particular handle configuration merely represents a preferred arrangement and various handle designs could be readily employed.

The embodiment of FIGS. 2 and 3 mainly differs from that of FIG. 1 due to the incorporation of a ice and/or water dispenser 66. Actually, dispenser 66 takes a form which is widely known in the art in that it is mounted for pivotal movement with freezer door 18 and includes a lever 67 for use in selectively dispensing ice and/or water. Therefore, this embodiment illustrates that varying the width of fresh food and freezer doors 15 and 18 in accordance with the present invention still enables a conventional dispenser system, such as illustrated by dispenser 66, to be readily incorporated in the overall refrigerator cabinet 2.

FIG. 3 illustrates the internal construction of refrigerator cabinet 2, which is preferably identical for both of the illustrated embodiments except for the dispensing system structure. More specifically, cabinet shell 5 has mounted therein a liner 69 which defines a fresh food compartment. For the sake of completeness, a temperature control unit 72 is shown mounted atop fresh food compartment liner 69. In addition, laterally spaced vertical rails 76 and 77 are secured to rear wall portions of liner 69 in order to support vertically adjustable shelves 80–82. Shelf 82 is also shown to support a drawer 84. As shown in this figure, rail 77 extends below drawer 84 and is used in combination with a laterally offset intermediate rail 85 to support additional shelves 86 and 87. Finally, FIG. 3 indicates the presence of lowermost, slidable storage bins 91 and 92.

Except for varying in width from typical side-by-side fresh food compartment shelves, drawers and bins, the construction and mounting of shelves 80–82, 86 and 87, drawer 84 and bins 91 and 92 are generally known in the art. Fresh food door 15 can also be provided with various food item storage units, such as a dairy compartment 95, shelves 96–99, a bin 100 and the like. Again, these storage units are generally known and it is to be understood that they merely depict exemplary storage arrangements usable in connection with the present invention. In addition, it should be realized that fresh food door 15 also has secured thereto an annular gasket 105 which is adapted to seal against a front flange 108 of cabinet shell 5, as well as at a compartment dividing wall or mullion 110, as will be discussed more fully below.

In a similar manner, a freezer liner 113 is mounted within cabinet shell 5. Due to the embodiment shown, freezer liner 113 has mounted therein an ice maker unit generally indicated at 114, various vertically spaced shelves 116–118 and lowermost slidable bins 119 and 120. The inside of freezer door 18 is shown to support various shelves 122–126. Again, all of these food item supporting units are known in the art and have simply been sized to correspond to the variations in widths of the various storage areas in accordance with the present invention. Most importantly, it should be realized that fresh food and freezer liners 69 and 113 have varying width sections corresponding to that of fresh food and freezer doors 15 and 18. Accordingly, mullion 110 takes on a different configuration than that found in conventional side-by-side refrigerators. More specifically, mullion 110 includes an upper vertical portion 135 and a lower vertical portion 137 which are interconnected by a laterally extending portion 140.

In the most preferred form of the invention, an upper section 144 of the fresh food compartment, as defined by liner 69, has been widened as compared to a conventional side-by-side refrigerator. In addition, a lower section 145 of the fresh food compartment has been narrowed in width. Correspondingly, an upper section 147 of the freezer compartment has been narrowed and a lower section 148 has been widened as compared to a conventional side-by-side refrigerator. With this reconfiguration, upper section 144 of the fresh food compartment and lower section 148 of the freezer compartment can accommodate larger food items than could previously fit in a corresponding section of a conventional side-by-side refrigerator. However, the overall available volume of both the fresh food and freezer compartments in accordance with the present invention need not deviate from that of a conventional side-by-side refrigerator. Of course, the volumes could be varied as desired, such as by simply widening an upper section of the fresh food compartment of a conventional side-by-side refrigerator, to arrive at a larger fresh food compartment than typically found, while corresponding reducing the volume of the freezer compartment. In any event, the overall outer dimensions of refrigerator cabinet 2 remain the same as on a conventional side-by-side refrigerator, in accordance with the most preferred form of the invention, such that refrigerator cabinet 2 can fit within a standard size refrigerator opening provided in a household kitchen.

Figure 4:
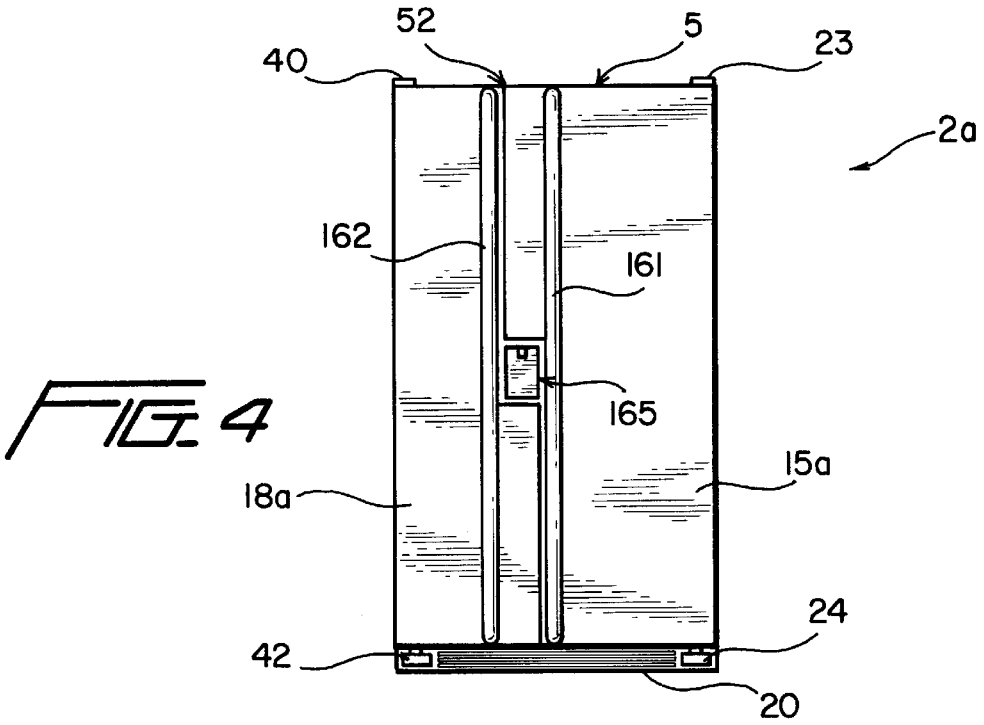
FIG. 4 is a front plan view of a closed refrigerator cabinet constructed in accordance with a third embodiment of the invention.
Figure 5:
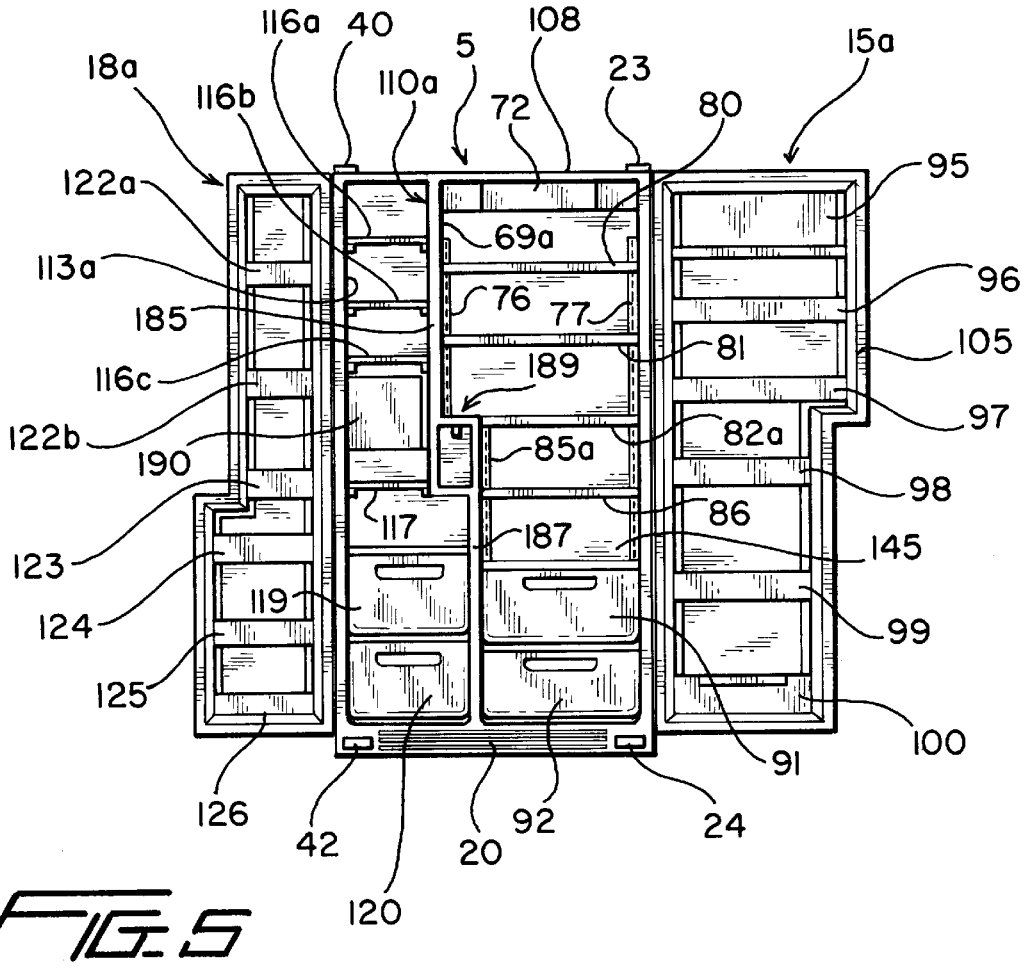
FIG. 5 is a front plan view of the refrigerator cabinet of FIG. 4 in an open condition.

FIGS. 4 and 5 depict another preferred embodiment of the invention. As shown, this embodiment has fresh food and freezer doors 15*a* and 18*a* which can be selectively opened through vertically elongated handles 161 and 162 respectively. Although a slight shelving variation is depicted (see shelves 82*a*, 116*a*, 116*b*, 116*c*, 122*a* and 122*b*), the main distinction between this embodiment and that of FIGS. 2 and 3 is the incorporation of a fixed ice and/or water dispenser generally indicated at 165. More specifically, dispenser 165 is fixed relative to both fresh food and freezer doors 15*a* and 18*a* and is preferably positioned both vertically and laterally between fresh food and freezer doors 15*a* and 18*a*. This configuration is considered particularly advantageous as it enables dispenser 165 to function regardless of the open condition of doors 15*a* and/or 18*a*. In addition, the potentially problematic, movable junction between the exposed dispenser portion and the ice delivery unit found in a conventional side-by-side refrigerator is eliminated.

To accommodate fixed dispenser 165, mullion 110*a* includes an upper vertical portion 185, a lower vertical portion 187 and a central box section 189. This enables the entire perimeter sealing of fresh food and freezer doors 15*a* and 18*a* to cabinet shell 5 and mullion 110*a*. Since fresh food and freezer doors 15*a* and 18*a* are adapted to seal against separate vertical and lateral segments of central box section 189, i.e., on either lateral side of dispenser 165, these segments are preferably more narrow than upper and lower vertical portions 185 and 187. As is widely known in the art, foam insulation is injected between the liners and the shell, as well as between the liners themselves in the mullion area, of a refrigerator. In this preferred embodiment, a sleeve (not shown) is simply fitted between fresh food and freezer compartment liners 69*a* and 113*a* prior to injecting the foam insulation in order to accommodate fixed dispenser 165. After the foam insulation cures, the sleeve can either remain or be removed. In either case, the dispenser 165, and also preferably an ice bin with delivery auger adapted to receive cubed ice from an ice maker unit 190 through a chute (not shown) extending through a side wall of freezer compartment liner 113*a*, is mounted in this zone to arrive at the configuration shown. Of course, it should be realized that the delivery of ice and/or water to dispenser 165 is actually simpler than with a conventional dispensing system, due to the fact that dispenser 165 is fixed, and can be accomplished in various ways without departing from the invention.

Based on the above description, it should be readily apparent that the present invention is generally directed to varying the width of the fresh food and freezer compartments of a side-by-side refrigerator such that at least upper and lower portions of the compartments vary in width, while the overall lateral dimension of the refrigerator maintains a conventional dimension. Also the invention is concerned with accommodating an ice and/or water dispenser in combination with such a refrigerator. Furthermore, the invention is directed to providing a fixed ice and/or water dispenser in a refrigerator. However, although described with reference to preferred embodiments of the invention, it should be understood that various changes and/or modifications can be made without departing from the spirit of the invention. Therefore, in general, the invention is only intended to be limited in accordance with scope of the following claims.

I claim:

1. A refrigerator cabinet assembly comprising:

a cabinet shell including a pair of laterally spaced side panels, a top panel interconnecting upper end portions of the side panels, and an open frontal zone permitting access to within the cabinet shell;

at least one liner positioned within the cabinet shell, said at least one liner being divided into laterally spaced, fresh food and freezer compartments separated by a fore-to-aft extending divider wall, said divider wall including at least first and second interconnected upright portions which are laterally offset, wherein each of the fresh food and freezer compartments has varying lateral dimensions; and fresh food and freezer doors each including an outer lateral portion pivotally mounted to the cabinet shell about a substantially vertical axis and an inner lateral portion defined by laterally offset sections, wherein the fresh food and freezer doors have vertically offset, varying width portions adapted to extend across and seal the fresh food and freezer compartments respectively.

2. The refrigerator cabinet assembly according to claim 1, wherein each of the fresh food and freezer compartments includes upper and lower sections, with the upper section of the fresh food compartment being wider than the lower section of the fresh food compartment and with the lower section of the freezer compartment being wider than the upper section of the freezer compartment.

3. The refrigerator cabinet assembly according to claim 2, wherein the fresh food and freezer compartments are defined by respective liners mounted within the cabinet shell.

4. The refrigerator cabinet assembly according to claim 3, wherein said divider wall is constituted by a mullion having a front surface against which the fresh food and freezer doors are adapted to seal, said mullion including a laterally extending segment interconnecting the first and second upright portions.

5. The refrigerator cabinet assembly according to claim 4, wherein the laterally extending segment is linear.

6. The refrigerator cabinet assembly according to claim 1, further comprising: a dispenser mounted between the side panels of the cabinet shell, said dispenser being exposed from in front of the refrigerator cabinet.

7. The refrigerator cabinet assembly according to claim 6, wherein the dispenser is mounted in the freezer door.

8. The refrigerator cabinet assembly according to claim 6, wherein the dispenser is fixed relative to both the fresh food and freezer doors.

9. The refrigerator cabinet assembly according to claim 8, wherein the dispenser is positioned both vertically and laterally between the fresh food and freezer doors.

10. In a side-by-side refrigerator including a cabinet shell in which is defined laterally spaced fresh food and freezer compartments each being selectively accessed by pivoting a respective one of fresh food and freezer doors attached to the cabinet shell, the improvement comprising:

an upper fresh food compartment section having a first lateral dimension, a lower fresh food compartment section having a second lateral dimension which is different from the first lateral dimension, an upper freezer compartment section having a third lateral dimension, and a lower freezer compartment section having a fourth lateral dimension which is different from the third lateral dimension, wherein each of the fresh food and freezer compartments has varying widths.

11. The side-by-side refrigerator according to claim 10, wherein the fresh food and freezer compartments are defined by respective liners mounted within the cabinet shell.

12. The side-by-side refrigerator according to claim 11, further comprising: a mullion having a front surface against which the fresh food and freezer doors are adapted to seal, said mullion including first and second upright portions interconnected by a laterally extending segment.

13. The side-by-side refrigerator according to claim 12, wherein the laterally extending segment is linear.

14. The side-by-side refrigerator according to claim 10, further comprising: a dispenser exposed from in front of the refrigerator.

15. The side-by-side refrigerator according to claim 14, wherein the dispenser is mounted in the freezer door.

16. The side-by-side refrigerator according to claim 14, wherein the dispenser is fixed relative to both the fresh food and freezer doors.

17. The side-by-side refrigerator according to claim 16, wherein the dispenser is positioned both vertically and laterally between the fresh food and freezer doors.

18. In a refrigerator including a cabinet shell in which is positioned fresh food and freeze liners respectively defining fresh food and freezer compartments each being selectively accessed by pivoting a respective one of fresh food and freezer doors attached to the cabinet shell and generally defining a front surface of the refrigerator, the improvement comprising: a dispenser for selectively delivering a supply of at least one of ice and water, said dispenser being exposed from the front surface of the refrigerator and fixed relative to both the fresh food and freezer doors, with said dispenser being surrounded by a portion of each of the fresh food and freeze liner.

19. The refrigerator according to claim 18, wherein the fresh food compartment includes an upper fresh food compartment section having a first lateral dimension, a lower fresh food compartment section having a second lateral dimension which is different from the first lateral dimension, and wherein the freezer compartment includes an upper freezer compartment section having a third lateral dimension and a lower freezer compartment section having a fourth lateral dimension which is different from the third lateral dimension, wherein each of the fresh food and freezer compartments has varying widths.

20. The refrigerator according to claim 19, wherein the first lateral dimension is greater than each of the second, third and fourth lateral dimensions and the fourth lateral dimension is greater than the third lateral dimension.

21. The refrigerator according to claim 18, wherein said dispenser is positioned between the fresh food line and the freezer liner.

22. The refrigerator according to claim 18, wherein the fresh food and freezer compartments are laterally spaced such that the refrigerator constitutes a side-by-side refrigerator.

* * * * *